United States Patent [19]

Olofsson

[11] 3,942,468

[45] Mar. 9, 1976

[54] BACK PRESSURE OPERATED SOUND TRANSMITTER

[75] Inventor: Svante Bertil Olofsson, Arlov, Sweden

[73] Assignee: Kockums Mekaniska Verkstads Aktiebolag, Arlov, Sweden

[22] Filed: Sept. 10, 1974

[21] Appl. No.: 504,473

[30] Foreign Application Priority Data

Sept. 24, 1973 Sweden ..... 7312952

[52] U.S. Cl. ..... 116/142 FP

[51] Int. Cl.[2] ..... G10K 9/00

[58] Field of Search .... 116/142 FP, 142 R, 142 FV; 251/45, 61.1; 137/509

[56] References Cited

UNITED STATES PATENTS

| | | | |
|---|---|---|---|
| 2,177,594 | 10/1939 | Eaves | 116/142 FP |
| 2,396,423 | 3/1946 | Hines | 116/142 FP |
| 3,581,705 | 6/1971 | Holm | 116/142 FP |
| 3,791,339 | 2/1974 | Dahlquist | 116/142 R |

*Primary Examiner*—Richard C. Queisser
*Assistant Examiner*—Daniel M. Yasich
*Attorney, Agent, or Firm*—Browne, Beveridge, De Grandi & Kline

[57] ABSTRACT

In a pressure gas driven, back pressure operated sound transmitter a damping chamber having an interior volume at least approximately equal to that of the back pressure chamber is inserted between the operating valve connected to the back pressure chamber and the throttle device bleeding gas from the back pressure chamber into the ambient atmosphere.

2 Claims, 1 Drawing Figure

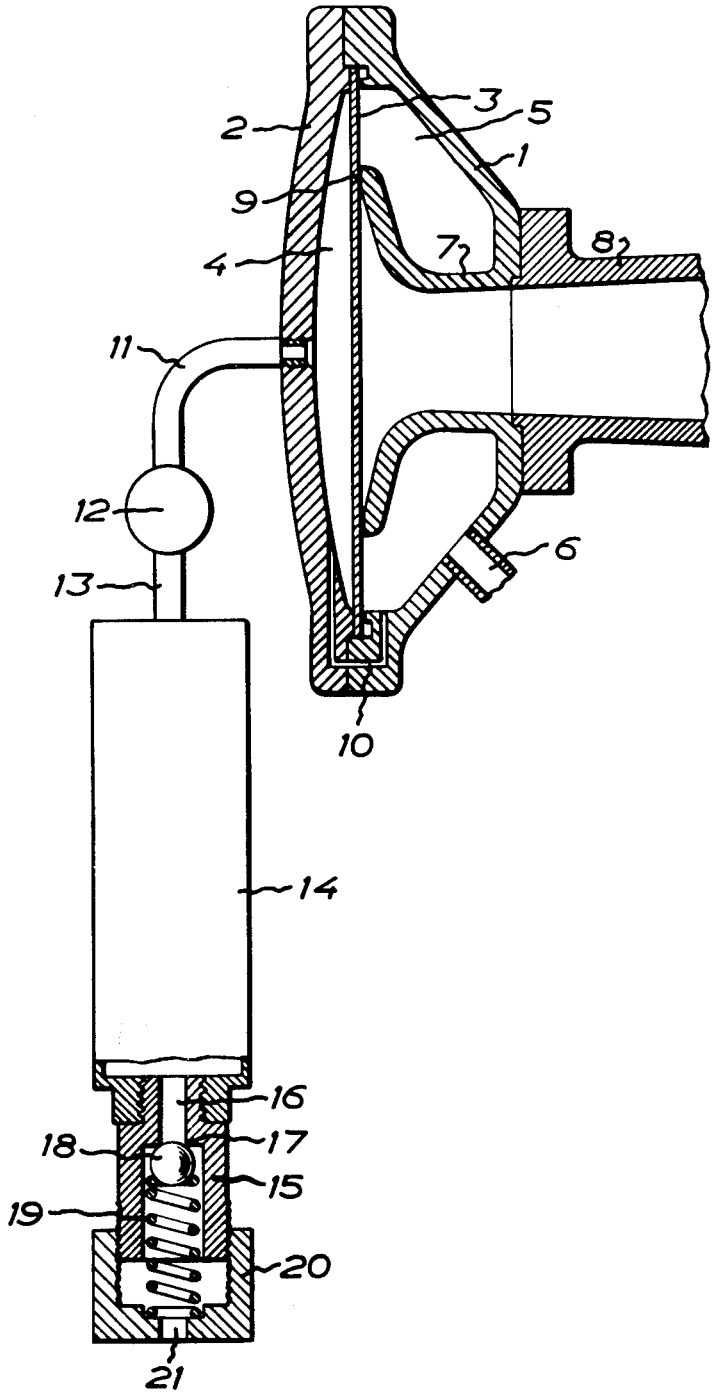
1
2
3
4
5
6
7
8
9
10
11
12
13
14
15
16
17
18
19
20
21

BACK PRESSURE OPERATED SOUND TRANSMITTER

This invention relates to a pressure gas driven, back pressure operated sound transmitter of the kind having a housing the interior of which is divided by means of a diaphragm into a back pressure chamber and an inlet chamber equipped with a pressure gas inlet and annularly surrounding the inlet end of a resonance horn, which inlet end has an annular seat against which the diaphragm can be sealingly pressed, the inlet chamber and the back pressure chamber being in constant communication with one another through a throttle passage, and the back pressure chamber being connected to the inlet of an operating valve the outlet of which is in communication with the ambient atmosphere via a throttle device, preferably a pressure reduction valve.

Such sound transmitters are usually driven by pressure air or steam under pressure, and they function as follows. With closed operating valve the same gas pressure prevails in the inlet chamber and the back pressure chamber. Acting upon a larger surface of the diaphragm in the back pressure chamber than in the inlet chamber, the gas pressure maintains the diaphragm sealingly pressed against the seat at the inlet end of the resonance horn so that the sound transmitter is silent and at rest. When the operating valve is opened a decrease of pressure occurs in the back pressure chamber in that gas from said back pressure chamber can flow through the operating valve and the throttle device to escape into the atmosphere. By the decrease of pressure in the back pressure chamber the diaphragm leaves the seat at the inlet end of the resonance horn so that pressure gas from the inlet chamber suddenly flows into the resonance horn and causes the gas body in the resonance horn to oscillate in resonance, whereby the diaphragm will close and open the communication between the inlet chamber and the resonance horn in step with said oscillations. The throttle device shall be so adapted as to maintain, in collaboration with the throttle passage between the inlet chamber and the back pressure chamber, the gas pressure in said back pressure chamber at a value so much lower than the gas pressure in the inlet chamber that the diaphragm steadily oscillates at a suitable amplitude in step with the resonance oscillations in the resonance horn. Upon closure of the operating valve the gas pressure in the back pressure chamber rises so that the diaphragm is steadily pressed against the seat at the inlet end of the resonance horn and the sound transmitter becomes silent.

It has proved difficult to make the sound transmitters of the above type operate steadily. There may arise starting difficulties upon opening of the operating valve; the diaphragm may temporarily oscillate at a wrong amplitude; and the diaphragm may begin to oscillate with harmonic frequency.

According to the invention, it has now proved possible to avoid these difficulties by giving a sound transmitter of the above type the construction characteristic to the invention, viz. that there is interposed between the outlet of the operating valve and the throttle device a damping chamber having an interior volume at least approximately equal to that of the back pressure chamber.

The present invention is based upon the discovery that the above mentioned difficulties are due, on the one hand, to the fact that the gas pressure in the back pressure chamber was not sufficiently suddenly decreased upon opening of the operating valve and, on the other hand, to the fact that variations in the gas pressure prevailing in the back pressure chamber that occurred during the oscillation of the diaphragm propagated themselves to the throttle device where they resulted in a pulsating release of gas into the ambient atmosphere. The construction characteristic of the invention eliminates these phenomena in a very high degree.

The invention will be more fully described hereinbelow and with reference to the accompanying drawing which diagrammatically illustrates the parts of a sound transmitter essential to the invention in side view and partly in section.

The FIGURE shows a sound transmitter according to the invention.

The sound transmitter illustrated in the drawing has a housing which consists of two parts 1 and 2. The two parts are secured together by screws (not shown), and the peripheral edge of a diaphragm 3 is mounted between them in a suitable, previously known manner. Said diaphragm forms a partition dividing the interior of the housing into a back pressure chamber 4 and an inlet chamber 5. An inlet 6 for pressure gas leads from a source of such pressure (not shown), such as air or steam under pressure, to the inlet chamber 5. In the embodiment illustrated the housing part 1 is integral with the inlet end 7 of a resonance horn customary in sound transmitters. The remaining portion 8 of said horn (but partly shown in the drawing) widens in the manner of a funnel and is secured to the housing part 1 by screws (not shown). The inlet chamber 5 annularly surrounds the inlet end 7 of the horn, which protrudes into the chamber 5 and is provided with an annular seat 9 against which the diaphragm 3 can be sealingly pressed.

The inlet chamber 5 and the back pressure chamber 4 are in constant communication with one another through a throttle passage 10 which, in the embodiment illustrated, is formed in the material of the housing parts 1, 2 but which may also be a small hole through the diaphragm 3. The throttling effect described in the following and realized by means of said throttle passage, may be made controllable, for instance by means of a needle valve interposed in the throttle passage, throttle washers or like means inserted therein. The back pressure chamber 4 is connected by means of a short line 11 with the inlet of an operating valve 12 of a suitable type, which can be opened for the initiation of sound transmission from the sound transmitter and closed for interruption of the sound transmission. The outlet of the operating valve 12 is connected by means of a short line 13 with a damping chamber 14 which is in communication with the ambient atmosphere via a throttle device. Said throttle device should be controllable so that the throttling effect provided by the throttle device may be adapted to that realized by means of the throttle passage 10. For such a control, use can be made of throttle washers in the throttle device, or of an adjustable needle valve. However, most preferable is to use a throttle device in the form of a pressure reduction valve means. Thus, in the embodiment chosen, use is made of a pressure reduction valve means in the form of a ball valve which has a valve housing 15 comprising an inlet passage 16 communicating with the interior of the damping chamber 14 and having a seat 17 against which a valve ball 18 can be pressed by a spring 19. A cap nut 20 having an outlet hole 21 opening into the atmosphere is screwed onto the valve housing 15. The spring 19 is interposed between the ball 18 and the bottom of the cap nut 20. By adjustment of the nut 20 of the valve housing 15 the tension of the spring 19 can be altered and as a consequence the gas pressure at which the ball 18 leaves the seat 17 and permits gas to escape from the damping chamber 14 into the ambient atmosphere through the exhaust 21.

The inlet chamber 5 is in constant communication with the source of pressure gas through the inlet 6. At closed operating valve 12 the pressure of the pressure gas source prevails in the inlet chamber 5, and said gas pressure also prevails in the back pressure chamber 4 because of the throttle passage 10 interconnecting the chambers 4 and 5. Since the pressure gas acts upon a larger surface of the diaphragm 3 in the back pressure chamber 4 than in the inlet chamber 1 (inside the seat 9 atmospheric pressure prevails on the side of the diaphragm 3 facing to the right in the drawing, because the resonance horn 7, 8 is in communication with the ambient atmosphere) the pressure gas will maintain the diaphragm 3 sealingly pressed against the seat 9 so that gas communication between the inlet chamber 5 and the interior of the horn 8 is disrupted and the sound transmitter is at rest and silent. Upon opening of the operating valve 12 the gas pressure in the back pressure chamber 4 suddenly sinks because gas from the chamber 4 can flow into the damping chamber 14 and the flow of gas from the inlet chamber 5 to the back pressure chamber 4 through the throttle passage 10 takes place under heavy throttling. The gas pressure in the inlet chamber 5 is therefore capable of urging the diaphragm 3 away from the seat 9 so that pressure gas flows from the chamber 5 into the resonance horn 7, 8 and initiates resonance oscillations in the horn. Owing to these oscillations the diaphragm 3 will alternately close and open the communication between the inlet chamber 5 and the interior of the resonance horn in a known manner. The sound transmitter now transmits sound. The initiation of the sound transmitter will be very reliable because of the sudden decrease of the gas pressure in the back pressure chamber 4, which is due to the gas contained therein being capable of expanding into the damping chamber 14 which is large as compared to the volume of the back pressure chamber 4. When the operating valve 12 has been opened the gas pressure in the damping chamber 14 rises until the valve ball 18 is urged away from the seat 17 and lets gas escape into the ambient atmosphere through the opening 21. The valve ball 18 will release gas into the atmosphere in response to the adjusted tension of the spring 19 in such a way that the valve tends to maintain the pressure in the damping chamber 14 at a constant value which in some degree is lower than the gas pressure in the inlet chamber 5. This pressure difference arises by interplay of the throttling effect in the passage 10 and the throttling effect provided by the valve ball 18, for at the release of gas from the damping chamber 14 into the atmosphere gas from the inlet chamber 5 will flow into the back pressure chamber 4 through the throttle passage 10. The tension of the spring 19 is so adjusted by means of the cap nut 20 that the stated difference in gas pressure in the damping chamber 14 and the inlet chamber 5 gives the desired amplitude to the diaphragm 3 during the oscillations thereof. When the diaphragm 3 oscillates the gas pressure in the back pressure chamber 4 will vary in step with the oscillations, but these pulsations in the gas pressure in the chamber 4 will be propagated in an unessential degree to the valve ball 18 because the pulsations are heavily damped in the large damping chamber 14. When the operating valve 12 is closed the pressure in the back pressure chamber 4 will rise due to incoming flow of pressure gas from the inlet chamber 5 through the throttle passage 10 so that the diaphragm 3 is firmly sealingly pressed against the seat 9 whereby sound transmission ceases.

In order that the damping chamber 14 shall function satisfactorily in the manner described the interior volume of the chamber must be adapted to the interior volume of the back pressure chamber 4. Thus, the interior volume of the damping chamber 14 must be at least approximately equal to that of the back pressure chamber 4 and preferably 1.5 to 3 times as large as the interior volume of the back pressure chamber.

What I claim and desire to secure by Letters Patent is:

1. A pressure gas driven, back pressure operated sound transmitter, comprising a housing, a back pressure chamber and an inlet chamber in said housing, a diaphragm forming a partition between said back pressure chamber and said inlet chamber, a pressure gas inlet to said inlet chamber, a resonance horn connected to said housing, an inlet end of said resonance horn protruding into said inlet chamber, an annular seat on said inlet end for co-operation with said diaphragm, said diaphragm being adapted sealingly to abut said seat for disrupting gas communication between said inlet chamber and the interior of said horn and to oscillate away from said seat for establishing such gas communication, throttle passage means forming a constant communication between said inlet chamber and said back pressure chamber, an operating valve, an inlet of said operating valve being connected to said back pressure chamber, damping chamber means, an outlet of said operating valve being connected to said damping chamber means, and pressure reduction valve means connected to said damping chamber means for venting said damping chamber means to the ambient atmosphere, said damping chamber means having an interior volume at least approximately equal to that of said back pressure chamber so as to ensure proper start of the sound transmitter on the fundamental frequency and with the proper amplitude and maintenance of such frequency and amplitude throughout the operation of the sound transmitter.

2. A pressure gas driven, back pressure operated sound transmitter, comprising a housing, a back pressure chamber and an inlet chamber in said housing, a diaphragm forming a partition between said back pressure chamber and said inlet chamber, a pressure gas inlet to said inlet chamber, a resonance horn connected to said housing, an inlet end of said resonance horn protruding into said inlet chamber, an annular seat on said inlet end for cooperation with said diaphragm, said diaphragm being adapted sealingly to abut said seat for disrupting gas communication between said inlet chamber and the interior of said horn and to oscillate away from said seat for establishing such gas communication, throttle passage means forming a constant communication between said inlet chamber and said back pressure chamber, an operating valve, an inlet of said operating valve being connected to said back pressure chamber, damping chamber means, an outlet of said operating valve being connected to said damping chamber means, and pressure reduction valve means connected to said damping chamber means for venting said damping chamber means to the ambient atmosphere, said damping chamber means having an interior volume being 1.5 to 3 times as large as the interior volume of said back pressure chamber so as to ensure proper start of the sound transmitter on the fundamental frequency and with the proper amplitude and maintenance of such frequency and amplitude throughout the operation of the sound transmitter.

* * * * *